US005833364A

United States Patent [19]

Rushing et al.

[11] Patent Number: 5,833,364

[45] Date of Patent: Nov. 10, 1998

[54] CHEMICAL DELIVERY AND ON-SITE BLENDING SYSTEM FOR PRODUCING MULTIPLE PRODUCTS

[75] Inventors: J. Mitchell Rushing, Greenville; Terry L. Scruggs, Taylors; John J. Malone, Simpsonville, all of S.C.

[73] Assignee: Calgon Corporation, Pittsburgh, Pa.

[21] Appl. No.: 153,860

[22] Filed: Nov. 17, 1993

[51] Int. Cl.[6] ..... B01F 15/04

[52] U.S. Cl. ..... 366/152.1; 366/160.1; 366/141; 366/177.1

[58] Field of Search ..... 366/132, 134, 366/141, 142, 138, 151, 152, 160, 162, 168, 182, 152.1, 160.1, 177.1

[56] References Cited

U.S. PATENT DOCUMENTS

| | | | |
|---|---|---|---|
| 3,365,177 | 1/1968 | Daman | 366/138 |
| 3,877,682 | 4/1975 | Moss | 366/152.2 |
| 4,353,482 | 10/1982 | Tomlinson et al. | 366/152 |
| 4,433,917 | 2/1984 | Mendez et al. | 366/152 |
| 4,475,821 | 10/1984 | Koch | 366/160.1 |
| 4,533,254 | 8/1985 | Cook | 366/182.4 |
| 4,863,277 | 9/1989 | Neal et al. | 366/141 |
| 4,889,433 | 12/1989 | Pratt | 366/152 |
| 4,918,659 | 4/1990 | Bragg et al. | 366/160 |
| 5,149,192 | 9/1992 | Hamm et al. | 366/152 |
| 5,288,145 | 2/1994 | Mackey et al. | 366/152 |
| 5,332,311 | 7/1994 | Volk, Jr. et al. | 366/152 |
| 5,340,210 | 8/1994 | Patel et al. | 366/161 |

FOREIGN PATENT DOCUMENTS

| | | | |
|---|---|---|---|
| 0232835 | 8/1987 | European Pat. Off. | 366/138 |
| 56-0136764 | 1/1981 | Japan | 366/138 |

OTHER PUBLICATIONS

DEMA, Cleaning Centers, p. 3, Model 611, Model 611–1, Model 611–2.

DEMA, Bulletin No. 93002, Blend Safe, Model 660–4, Model 660.

DEMA, Bulletin No. 93003, Blend Center, Model 633, Model 681–3.

DEMA, Bulletin No. 93004, Cleaning Center, Model 636.

*Primary Examiner*—David Scherbel
*Assistant Examiner*—Randall E. Chin
*Attorney, Agent, or Firm*—W. C. Mitchell; D. R. Meyers

[57] ABSTRACT

A chemical delivery and on-site blending system for producing multiple products is provided. Generally, chemical subcomponents are fed to a chemical blending system for making a multitude of products at the facility where the products are to be used. Also, a water line is connected to the system for blending with the subcomponents and for rinsing the system equipment. A microprocessor controls a series of inlet valves, a feed pump, and a mixer for formulating the products in a mixing tank. A flow meter monitored by the microprocessor measures the amounts of ingredients entering the tank. Once formulated, a product is discharged from the tank by a discharge pump also controlled by the microprocessor. Included with the system is a timed rinse cycle which rinses the tank after the product has been discharged.

10 Claims, 7 Drawing Sheets

CHEMICAL DELIVERY AND ON-SITE BLENDING SYSTEM FOR PRODUCING MULTIPLE PRODUCTS

BACKGROUND OF THE INVENTION

The present invention relates generally to a delivery and a chemical blending system for blending chemical subcomponents on site into a multitude of chemical products. Also included is a process incorporating the chemical blending system.

In the chemical industry, suppliers typically offer a variety of products designed to target a specific market. Consequently, it is not uncommon for a chemical supplier to supply a variety of related chemical products to one particular customer. Many of these chemical products, although used for different applications or in different chemical processes, contain many of the same components. For instance, water is commonly added to most products as a diluting agent.

In supplying these products, a large proportion of their cost is for their transportation and delivery. Chemical suppliers and distributors, therefore, have been searching for economically effective ways of delivering their chemical products. For instance, some suppliers transport each of their chemical products in bulk. The products are delivered to a facility in large tanks on trucks or rail cars and emptied into holding tanks operated by the customer. In this situation, fewer trips to each customer are necessary. However, each product must be shipped separately and the customer is burdened with maintaining several large tanks. Also, if the product being shipped has been diluted with water, the customer is charged indirectly for the transportation of that water when paying the delivery cost for the product.

Other chemical suppliers ship their products in 55-gallon drums. The customer, therefore, would not have to maintain large receiving tanks. However, packaging costs can be very high. The drum can represent a significant portion of the cost of the product. Also, the customer is still paying for the transportation of water when water is a constituent of the product. Further, the disposal of emptied 55-gallon drums can be very expensive. Depending upon their chemical contents, a used drum can be labeled as a regulated waste. As such, an emptied drum would have to be sent to a specialized facility for disposal.

In order to alleviate the transportation costs of shipping diluted products, some chemical distributors have transported their products in a more concentrated state. After delivery, the customer can then add water to the concentrated subproduct to arrive at a desired dilution. Typically, water is injected into a line as the chemical is being used. Problems have been encountered, however, in maintaining the correct water to product ratio and in allowing for adequate mixing of the solution. Further, although shipping concentrated products, the distributor still must transport each product separately.

Thus, chemical suppliers have attempted to find an economical and efficient way to transport their products. However, shortcomings of the prior art are numerous. Specifically, the prior art fails to provide a cost effective system for delivering several related chemical products to a particular customer. Related products generally are products that contain common ingredients and are often used to target a specific market.

SUMMARY OF THE INVENTION

The present invention recognizes and addresses the foregoing disadvantages, and others, of prior art for supplying chemicals to customers.

Accordingly, it is an object of the present invention to provide a process for supplying chemical products to customers.

It is another object of the present invention to provide a chemical blending system.

It is a further object of the present invention to provide a chemical blending system that can blend solutions on site for customer use.

It is another object of the present invention to provide a process for blending chemical subcomponents into desired chemical products on site without having to transport each particular product individually.

It is still another object of the present invention to supply concentrated chemical subcomponents to a customer, whereas the customer supplies water for mixing with the subcomponents.

It is another object of the present invention to provide a fully automated chemical blending system that can blend predetermined quantities of chemical subcomponents and water into multiple products for use in particular applications.

Additional objects and advantages of the invention are set forth in or will be apparent to those of ordinary skill in the art from the detailed description which follows. Also, it should be further appreciated that modifications and variations to this specifically illustrated and discussed features or materials hereof may be practiced in various embodiments and uses of this invention without departing from spirit and scope thereof, by virtue of present reference thereto. Such variations may include, but are not limited to, substitution of equivalent means and features or materials for those shown or discussed, and the functional or positional reversal of various parts, features, or the like. Still further, it is to be understood that different embodiments, as well as different presently preferred embodiments of this invention may include various combinations or configurations of presently disclosed features or elements, or their equivalents (including combinations or configurations thereof not expressly shown in the figures or stated in the detailed description). One such exemplary embodiment of the present invention relates to a chemical delivery and on-site blending system for forming a plurality of preselected chemical products at a use site. The present invention also encompasses a process for using the chemical delivery and on-site blending system.

Preferably, the process is for supplying a plurality of preselected chemical products to a determined use site by forming the chemical products at the site without having to deliver them individually. The process includes supplying to a determined use site a plurality of preselected respective chemical subcomponents for blending into a plurality of preselected chemical products. The subcomponents are generally in a chemically concentrated state. As used hereinafter, a chemically concentrated state refers to a chemical in which water or any other dilutent is added before the chemical is at a desired strength for use. The subcomponents are preselected so that a set number of the preselected subcomponents can yield through controlled on-site mixing a predetermined number of preselected chemical products in which the predetermined number of chemical products is higher than the set number of chemical subcomponents. Predetermined measured amounts of certain of the subcomponents are fed into a mixing tank for blending into a user selected one of the respective chemical products. The subcomponents are mixed for a predetermined interval of time for forming the user selected chemical product. The on-site formed product is then discharged from the mixing tank for selective storage and use of the on-site product at the site. Formation of the on-site, user selected chemical product from the respective chemical subcomponents is automated by a central processing means having a user input control panel so that an on-site user can activate the process for automatically forming the chemical products.

The process can further include the step of feeding a predetermined measured amount of water into the mixing tank with the respective chemical subcomponents. The water preferably comes from a water source at the site and, therefore, is not transported with the chemical subcomponents. Further, the process can include the step of rinsing the mixing tank with water after one of the preselected products has been formed and discharged from the tank. The water again preferably comes from a water source located at the use site.

The chemical subcomponents can be pumped into the mixing tank and are fed to the mixing tank one at a time. The central processing means receives information from a flow detecting instrument for determining the predetermined measured amounts of the chemical subcomponents.

In another embodiment, the process for forming a plurality of preselected chemical products at a determined site for use from a plurality of respective chemical subcomponents is fully automated and includes a programmable, electrical processing means having a user input control panel. A user activates one of a plurality of product select switches for forming one of the corresponding chemical products. The process includes supplying to a determined use site a plurality of preselected respective chemical subcomponents for blending into a plurality of preselected chemical products. The subcomponents are generally in a chemically concentrated state. Predetermined measured amounts of certain of the subcomponents are fed into a mixing tank for later blending into a user selected one of the respective chemical products. A predetermined measured amount of water is also fed into the mixing tank. The water preferably comes from a water source at the use site and, therefore, is not transported with the chemical subcomponents. The subcomponents and the water are mixed for a predetermined interval of time for forming the user selected chemical products. The on-site formed product is then discharged from the mixing tank for selectively storing and using the product at the site. From the process, more chemical products are formed than there are respective chemical subcomponents such that a lesser number and quantity of chemicals are transported to the use site than if each of the chemical products were transported individually.

The process can further include the step of rinsing the mixing tank with water after one of the preselected products has been formed and discharged from the tank. The water preferably comes from a water source at the use site.

The present invention includes a chemical delivery and on-site blending system for forming at a determined use site a plurality of preselected chemical products from a plurality of respective chemical subcomponents. The chemical subcomponents are fed to the system from a plurality of corresponding containment tanks. The system includes a plurality of inlet valves for respectively controlling the flow of a plurality of chemical subcomponents into the system. The valves drain into a common chemical feedline. A chemical feed pump pumps predetermined measured amounts of the subcomponents from the chemical feed line into a mixing tank. A quantity monitoring means monitors the amounts of the chemical subcomponents entering the mixing tank. A mixing means mixes the subcomponents for a predetermined interval of time inside of the mixing tank for forming the chemical products. The chemical delivery and on-site blending system further includes a central control means for automatically forming a user selected one of the plurality of preselected products by operating the plurality of inlet valves and allowing predetermined measured amounts of certain of the subcomponents to enter the feedline. The amounts are ascertained by receiving information from the quantity monitoring means. The central control means further operates the chemical feed pump and the mixing means in preselected and automated patterns for blending the subcomponents into one of the chemical products at the use site. The chemical products can be formed at the use site without having to deliver each of the products to the site individually.

The chemical delivery and on-site blending system can further include a water intake line connected to one of the plurality of inlet valves. The water can be used for blending with the subcomponents. Further, the chemical delivery and on-site blending system can include a water rinse line also connected to the plurality of inlet valves and emptying into the mixing tank. The rinse line can include a spray nozzle inside of the tank for rinsing the tank after the respective chemical products have been formed. The system can include a chemical exit line connected to the mixing tank, a chemical pump and an exit valve for discharging the chemical products from the tank. The chemical exit line can branch off into a plurality of discharge lines, each having a corresponding exit valve.

The quantity monitoring means included in the chemical delivery and on-site blending systems can include an electronic flow meter capable of electronically transmitting information or can include a load cell which measures the amounts of the subcomponents entering the tank by sensing weight differences in the tank. The mixing means can include a mixer or an agitator located within the tank. The central control means can include a programmable electronic control device incorporating a microprocessor for storing programs containing information for forming the chemical products. The electronic control device can include a control panel having a plurality of product select switches which respectively correspond to the plurality of preselected products for automatically forming the products when activated.

A method of forming a plurality of preselected chemical products from a plurality of respective chemical subcomponents includes utilizing the above-described chemical delivery and on-site blending system.

Another present exemplary embodiment concerns an automated chemical delivery and on-site blending system for forming a plurality of preselected chemical products at a determined use site. This system includes a plurality of product select switches on a user input control panel corresponding to a respective plurality of chemical products. A user need only activate one of the product select switches and the start button for automatically forming one of the respective products. The chemical delivery and on-site blending system includes a plurality of containers for respectively holding a corresponding plurality of preselected chemical subcomponents for subsequent controlled blending into a plurality of respective chemical products that are selected by a user. The chemical subcomponents are generally in a chemical concentrated state. A water intake line supplies water to the system for controlled dilution of the chemical subcomponents. The water is preferably supplied from a water source at the site. A plurality of intake valves generally corresponding to the containers and to the water intake line controls the flow of the chemically concentrated subcomponents and the water during formation of the chemical products. This system further includes a chemical feed pump for pumping predetermined measured amounts of the subcomponents and the water into a mixing tank and a means for monitoring the quantity of the subcomponents the water entering the tank. A mixing means mixes the subcomponents and the water for a predetermined interval of time inside of the mixing tank, thereby forming a user selected one of the chemical products. A chemical exit line is connect to the mixing tank. A chemical exit pump and an exit valve are used for discharging the user selected chemical products from the tank for selective storage and use at the site. A programmable electronic device including a microprocessor electronically connected to the plurality of product select switches stores information for automatically forming the chemical products when the respective product select switches are user activated.

The foregoing chemical delivery and on-site blending system can include a water rinse line connected to the plurality of inlet valves and emptying into the mixing tank. The rinse line includes a spray nozzle inside of the tank for rinsing the tank after the chemical products have been formed and discharged. The chemical exit line can branch off into a plurality of discharge lines, each having a corresponding exit valve. Further, a drain line can be connected to the bottom of the tank, including a gravity drain valve for providing an alternate means for draining the tank.

In the above chemical delivery and on-site blending system, the plurality of containers for holding the respective chemical subcomponents can be stackable. In other embodiments, the containers define openings for receiving the tines of a forklift for safe and easy movement of the containers. The containers can be sized for efficient storage on trucks and railcars.

The quantity monitoring means described above can include a flow meter capable of transmitting electronic information to the programmable electronic device for measuring the controlled amounts of the chemical subcomponents and the water. The quantity monitoring means could also include a load cell which measures amounts of the chemical subcomponents entering the mixing tank by sensing weight differences in the tank. The mixing means can include a mixer located within the mixing tank.

As one example, the on site chemical blending system of the present invention is particularly applicable and useful to chemical suppliers of cleaners and cleaning solvents. For instance, products used to clean machines, equipment, parts, and processes typically contain common ingredients. Most of the ingredients include water, sodium hydroxide, sodium hypochlorite or bleach, along with a variety of detergents, surfactants and solvent cleaners. From these ingredients, suppliers can blend an infinite variety of products for use in varying applications. The blend used to formulate a particular product depends upon the object to be cleaned, the presence of other chemicals, the waste matter that is to be removed, and the conditions under which cleaning will occur. Sometimes these products will be tailored to an individual customer. And, depending upon the industry in which the customer is involved, the customer may need many different cleaning products for application to a variety of machinery or a variety of processes.

By using the chemical blending system, a chemical supplier need only transport the concentrated chemical subcomponents to the customer's facility. The chemical supplier does not have to transport each product individually. By supplying water to the system, the customer is not charged for transporting it. Therefore, a chemical supplier is transporting fewer chemical products to a customer and, with the deletion of water, is transporting a smaller overall quantity. Consequently, transportation and delivery costs are decreased. In fact, even the cost of liability insurance, which has dramatically increased for chemical distributors, is reduced.

Those of ordinary skill in the art will better appreciate the features and aspects of such embodiments, and others, upon review of the remainder of the specification.

BRIEF DESCRIPTION OF THE DRAWINGS

A full and enabling disclosure of the present invention, including the best mode thereof, to one of ordinary skill in the art, is set forth more particularly in the remainder of the specification, including reference to the accompanying figures, in which.

Figure 1:
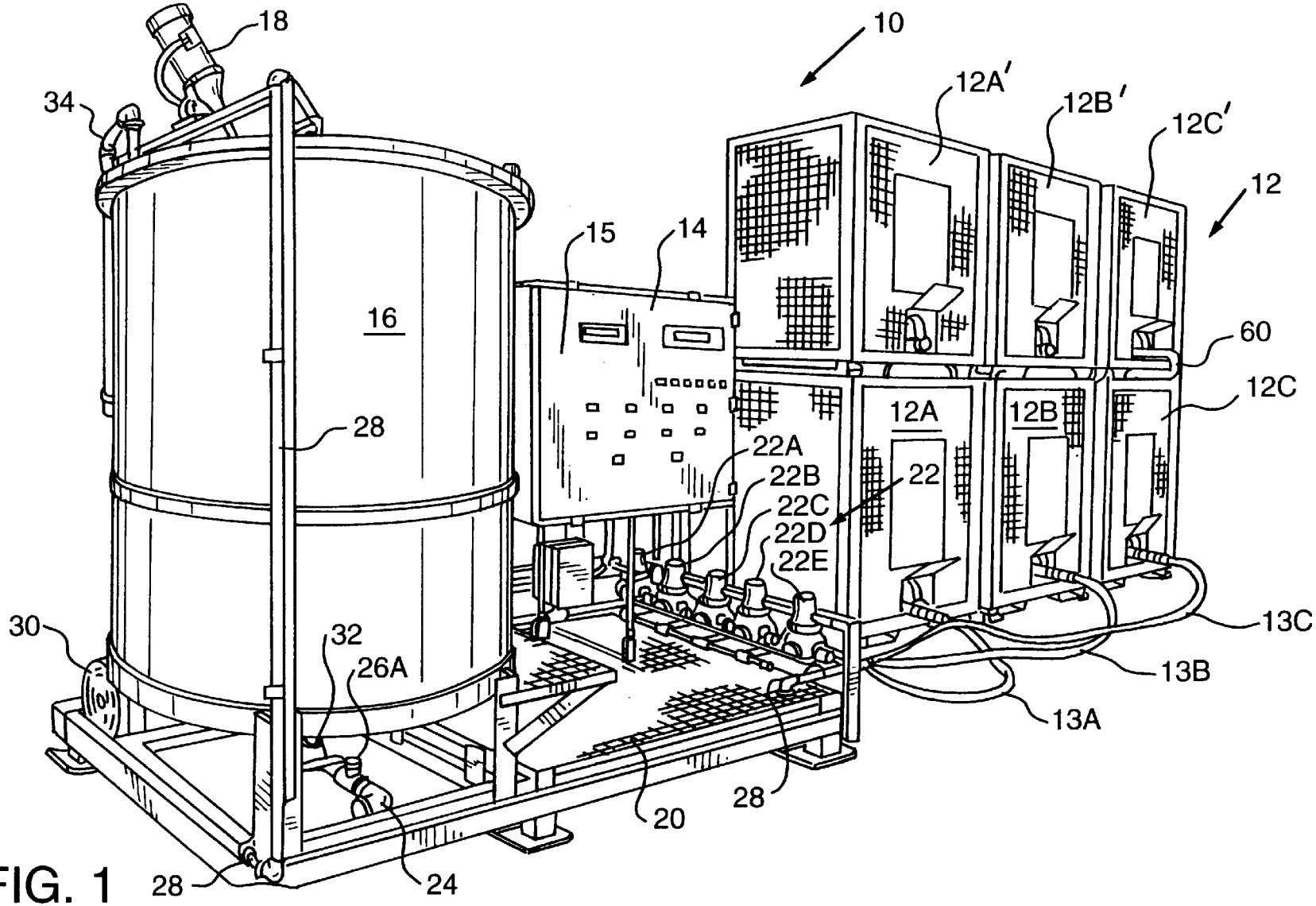
FIG. 1 is a perspective view of a chemical blending system in accordance with the present invention.

Repeat use of reference characters in the present specification and drawings is intended to represent same or analogous features or elements of the invention.

DETAILED DESCRIPTION OF PREFERRED EMBODIMENTS

It is to be understood by those of ordinary skill in the art that the present discussion is a description of exemplary embodiments, and is not intended as limiting the broader aspects of the present invention, which broader aspects are embodied in the exemplary construction.

Referring to FIG. 1, a preferred embodiment made in accordance with the present invention is illustrated. An on-site chemical blending system, generally 10, is shown. Blending system 10 includes a plurality of chemical subcomponent tanks, generally 12, which contain the chemical subcomponents used to make the various products. In this particular embodiment, six subcomponent tanks 12A, 12A', 12B, 12B', 12C and 12C' are shown stacked in pairs. One chemical subcomponent is stored in each pair of stacked tanks 12. Consequently, three subcomponents are fed to blending system 10 in the embodiment shown in FIG. 1. Although any size tank or reservoir could be used to feed chemicals to system 10, subcomponent tanks 12 are easy to move, lift and transport.

Figure 6:
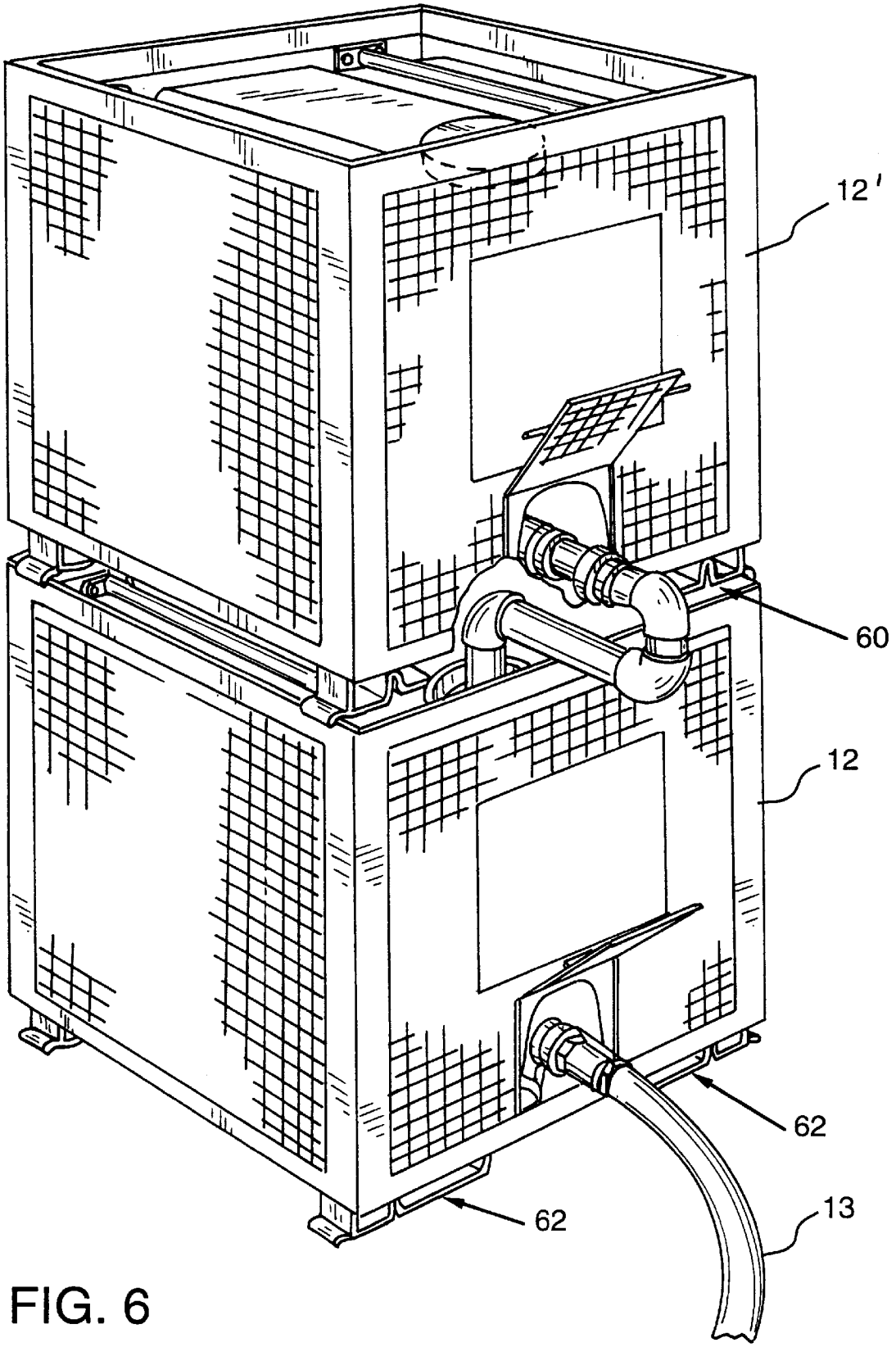
FIG. 6 is a perspective view of a pair of chemical subcomponent tanks in accordance with the present invention.

Referring to FIG. 6, a pair of subcomponent tanks 12 and 12' are shown stacked one on top of the other. Tanks 12 and 12'0 are designed to contain and feed a single chemical subcomponent to chemical blending system 10. Tank 12' drains into tank 12 by means of a connecting tube 60 while the chemical subcomponent is fed to blending system 10 through a feed hose 13. Consequently, when tank 12' is empty, it can be removed and replaced with a similar subcomponent tank full of the chemical ingredient. In this manner, bottom tank 12 is never completely empty and therefore can continuously feed chemical to blending system 10. The subcomponent tanks generally 12 can also be used for transporting the chemical ingredients to a customer's facility. The stackability of tanks 12 allows them to be efficiently spaced on a truck or rail car. Tanks 12 define channels 62 for receiving the tines of a forklift for providing a safe and efficient means for lifting and transporting the tanks. Also, subcomponent tanks 12 are equipped with an exterior metal screen for protecting its contents.

Referring back to FIG. 1, subcomponent tanks 12A, 12B and 12C drain into feed hoses 13A, 13B and 13C, respectively. Hoses 13A, 13B and 13C are connected to a series of inlet valves, generally 22. Specifically, feed hose 13A is connected to inlet valve 22A, feed hose 13B is connected to inlet valve 22B and feed hose 13C is connected to inlet valve 22C. The remaining valves 22D and 22E are connected to a water line usually provided on site by the customer.

Figure 3:
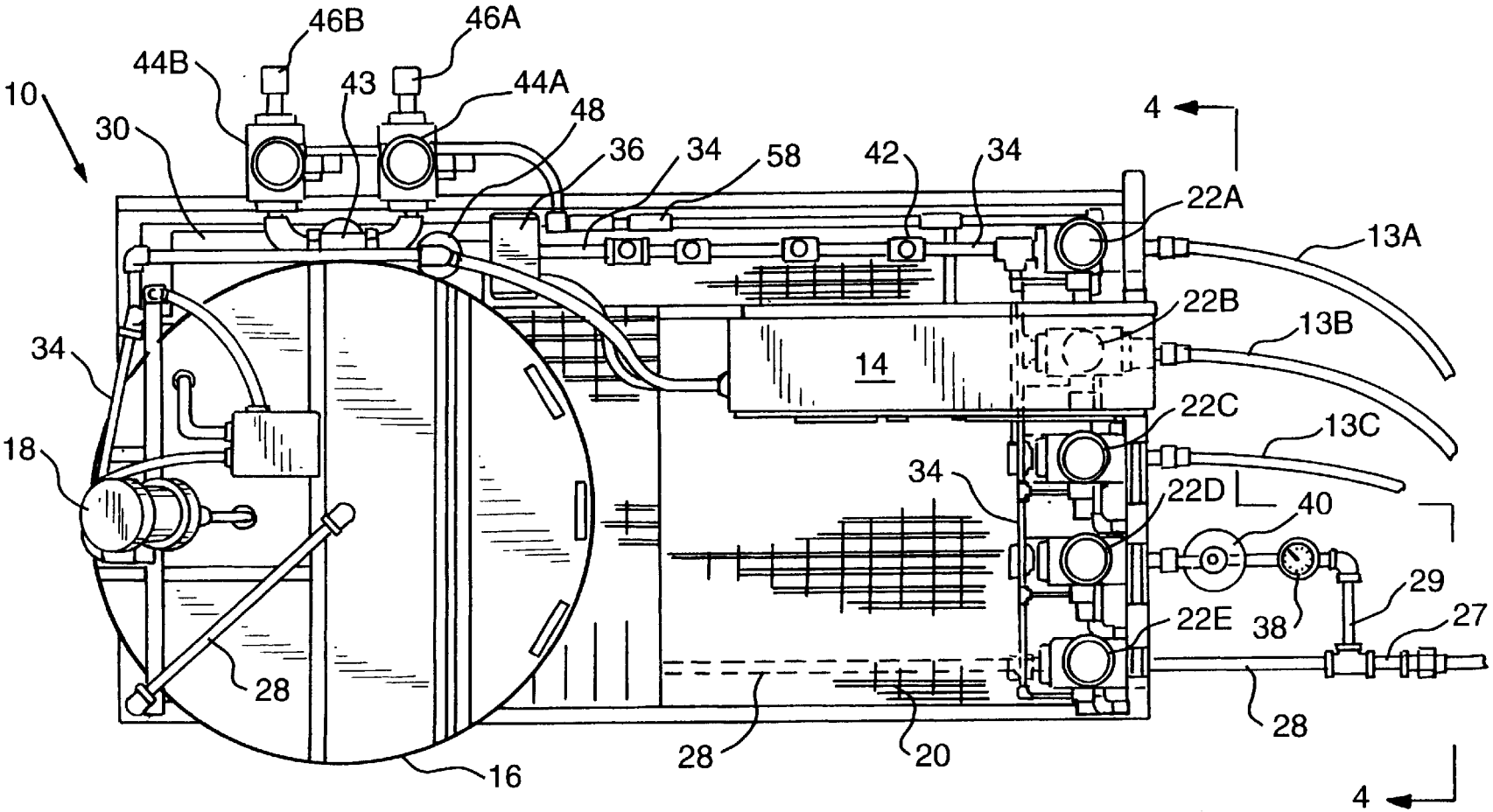
FIG. 3 is a top view of the chemical blending system as illustrated in FIG. 1.
Figure 4:
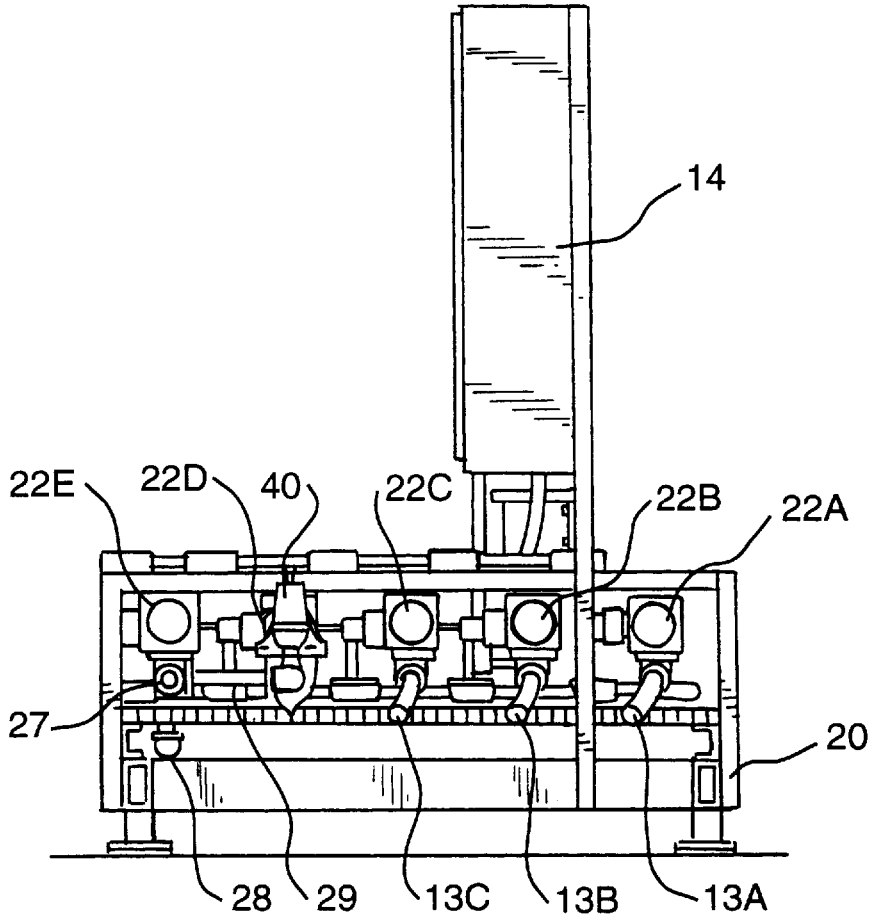
FIG. 4 is another side view of the chemical blending system illustrated in FIG. 1 taken along 4—4 of FIG. 3.

FIGS. 3 and 4 better illustrate the series of inlet valves 22. The purpose of valves 22 is to stop, start, and regulate the flow of the chemical subcomponents and the water feeding into blending system 10. Preferably, the opening and closing of valves 22 can be controlled by a microprocessor via an electrical connection. In one embodiment, valves 22 are solenoid valves integral with an actuator which can electronically control the position of the valve. Such valves are manufactured by El-O-Matic International, Hackensack, N.J. As shown in FIGS. 3 and 4 and as discussed above, inlet valves 22A, 22B and 22C are connected to feed hoses 13A, 13B and 13C, respectively, which supply the chemical subcomponents to blending system 10. Inlet valves 22D and 22E are connected to a water line 27 which is preferably supplied to blending system 10 from the facility where system 10 is to be used. As shown in FIG. 3, water line 27 branches off into a water rinse line 28 and a water feed line 29. Rinse line 28 is connected to inlet valve 22E and thereafter runs beneath a support base 20, ultimately emptying into the top of a mixing tank 16. In this arrangement, when valve 22E is open, water flows into and rinses mixing tank 16. Preferably, a tank washing nozzle is fitted on the end of rinse line 28 inside of mixing tank 16. Spray nozzles produce high speed sprays in multiple directions for rinsing the walls of a tank. The rinsing operation normally occurs after a product has been formulated and discharged.

Water line 27 also branches into water feed line 29 which is connected to inlet valve 22D. Water feed line 29 also includes a pressure gauge 38 and a pressure regulator 40 located before inlet valve 22D. Water feed line 29 supplies water to blending system 10 for blending with the chemical subcomponents. Consequently, it is important that the quantity of water entering mixing tank 16 be accurately measured when formulating a product. In order to more accurately measure the flow rate of the water, pressure regulator 40 ensures that water enters the system at a constant pressure and therefore at a constant flow rate. Pressure regulator 40 also ensures that water at a high pressure does not enter the system and damage any of the components. Pressure gauge 38 monitors the pressure of the incoming water. If the water pressure were too high, a different water source could be used or other control devices could be installed on water line 27.

Inlet valves 22A, 22B, 22C and 22D all drain into a common chemical feed line 34. From intake valves 22, feed line 34 runs down the length of support base 20 and ultimately empties into the top of mixing tank 16. In the particular embodiment illustrated in the figures, chemical blending system 10 has three chemical subcomponent feed lines, a water feed line and a rinse line. However, the chemical blending system of the present invention is capable of receiving as many additional feed lines as are necessary. For example, as shown in FIGS. 2 and 3, a series of connections 42 are included on chemical feed line 34 for further valve connections and therefore to accommodate several more chemical subcomponents.

Figure 2:
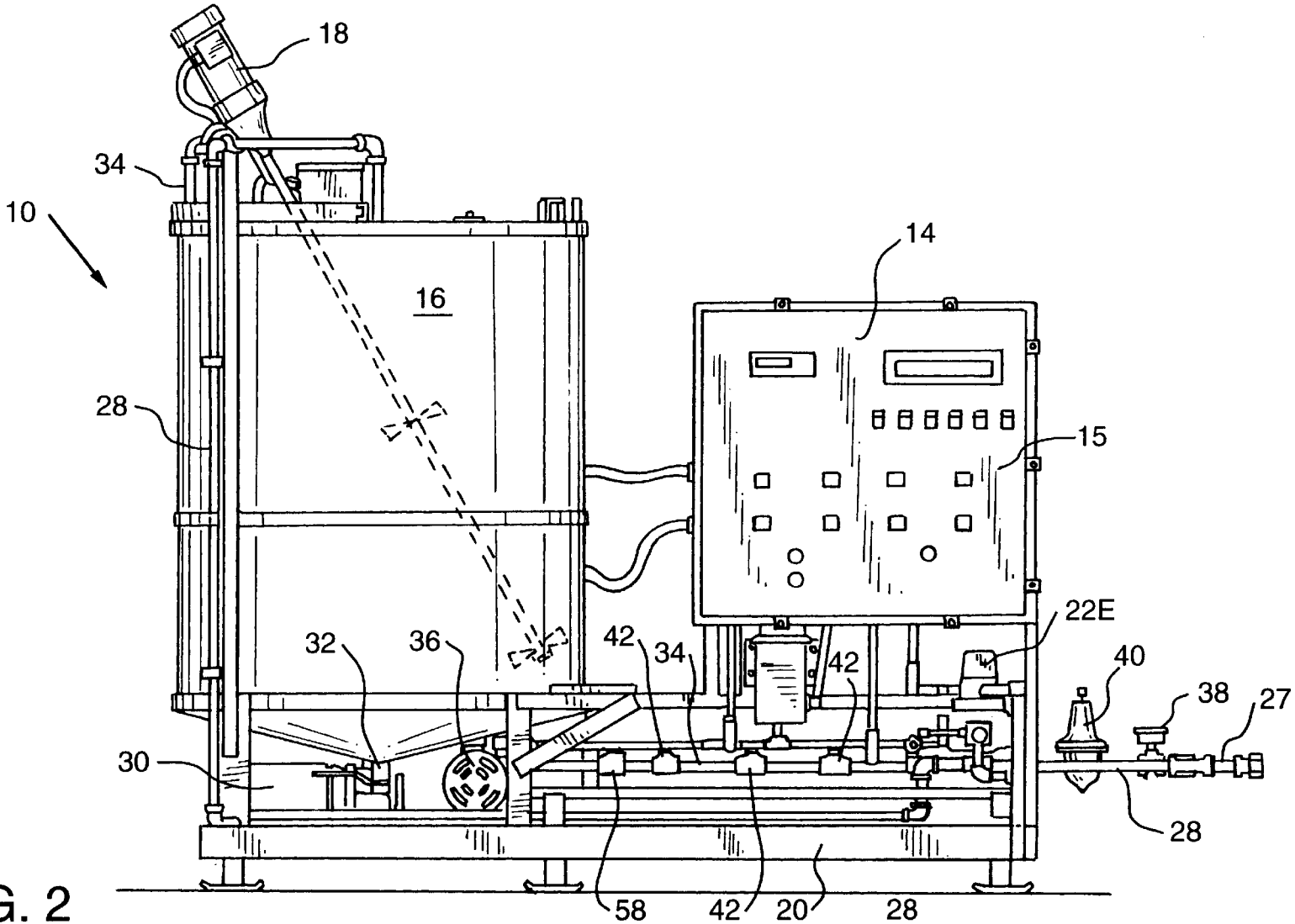
FIG. 2 is a side view of the chemical blending system as illustrated in FIG. 1.

Referring to FIGS. 2 and 3 and as stated above, the chemical subcomponents and water drain into chemical feed line 34. A feed pump 36 pumps the ingredients into mixing tank 16. In order to eliminate foaming of the product, feed line 34 preferably ends at the bottom of mixing tank 16. Therefore, the ingredients entering tank 16 do not splash against the tank walls or create excessive turbulence which would cause foaming. However, because feed line 34 ends at the bottom of tank 16, a check valve 58 is preferably installed along feed line 34. Check valve 58 prevents any backflow of product in feed line 34.

Check valve 58 can be located anywhere along feedline 34. In other embodiments, check valve can be located within tank 16. Also, two check valves can be incorporated into the system, one inside of tank 16 and the other as shown in the figures.

Along chemical feed line 34 is a flow meter 48 located after feed pump 36. When fabricating a product, each ingredient is fed to mixing tank 16 separately. Flow meter 48 measures the quantity or volume of each ingredient entering tank 16. Therefore, flow meter 48 acts as an indicator for determining when a desired amount of ingredient has been added. Preferably, flow meter 48 can send an electronic signal to a central processing unit or a microprocessor. When a specified amount of a particular ingredient has been added to mixing tank 16, the central processing unit will interpret that data from flow meter 48 and, in turn, close inlet valve 22 stopping the flow of the chemical ingredient. Thereafter, the next ingredient can be fed to mixing tank 16 following the same procedure. Flow meters of the type described above are sold by Krohne America, Inc., Peabody, Mass.

Although a flow meter is preferred, other devices can be employed to measure the quantity of ingredients entering mixing tank 16. For instance, a load cell could be installed. Instead of measuring the volume, a load cell measures the weight of the ingredient being added. Similar to a flow meter, a load cell could indicate when a desired quantity of an ingredient has been added to tank 16 by monitoring the weight change of the tank. However, by experimentation, it has been found that load cells are not as accurate as flow meters. Further, load cells are more delicate instruments. For instance, if anyone leaned on mixing tank 16 in order to look inside while a chemical ingredient was being fed, a load cell would register the outside force as part of the quantity of the added ingredient.

Besides a load cell, other means of measuring an ingredient being added to mixing tank 16 could include a bobber that measures the level of liquid in the tank as it increases. Also, a series of level indicators could be mounted on the inside of the tank wall indicating the level of the liquid. Tank 16 could even be made from a see-through material and the tank level could be monitored manually. However, the most precise and preferred method is to use a flow meter. Precision is normally very crucial when formulating a chemical product.

As stated above, the ingredients of a particular product are added and blended in tank 16. Mixing tank 16 preferably is cylindrical in shape. For instance, if tank 16 were square, it would take longer to adequately mix a product; the corners of square tanks tend to create slower flow regions. The size of mixing tank 16 can vary depending upon the amount of product needed to be formulated in a single batch. Typically, a 500 gallon tank would be adequate. Also, mixing tank 16 is preferably covered so that the product is contained within the tank during mixing.

In order to mix the ingredients after they have been added to tank 16, an agitator 18 has been mounted on top of tank 16. Agitator 18 consists of an electric motor that rotates a shaft with propellers mounted thereon. As the propellers rotate, the solution is mixed. Such agitators are distributed by Neptune Mixer Company, Lansdale, Pa. Of course, there are many other means for mixing the products. For instance, if mixing tank 16 were of a smaller size, the whole tank could be shaken. As another example, a propeller could be mounted on the bottom of tank 16 and rotated by a motor.

On the bottom of mixing tank 16 is an exit line 32 as shown in FIGS. 1 and 2. Exit line 32 branches off in two directions forming a gravity drain line 24 as shown in FIG. 1 and a pump line 43 as shown in FIG. 3. Pump line 43 branches off again into discharge lines 46A and 46B. The flow in discharge lines 46A and 46B is controlled by discharge valves 44A and 44B, respectively. Discharge valves 44A and 44B can be the same type of valve as inlet valves 22, only rated for higher flow rates.

When a product has been blended in mixing tank 16 or after a rinse cycle has been completed, the solution in mixing tank 16 is discharged by turning on a discharge pump 30 and pumping the solution out one or both of discharge lines 46A and 46B. It is not necessary that two discharge lines exist. However, by having two or more discharge lines, a user of chemical blending system 10 can direct the flow of a blended product or rinse to different destinations without having to switch connections or move lines. For instance, in the embodiment shown in FIG. 3, a product could be pumped out discharge line 46A for use in plant operations. Thereafter, the rinse could be pumped out discharge line 46B and discarded. Also, if desired, a product could be pumped out lines 46A and 46B simultaneously in order to service two different plant systems. Overall, the number of discharge lines included on a particular system 10 will depend upon the number of blended products being fabricated and the customer's needs.

Figure 7:
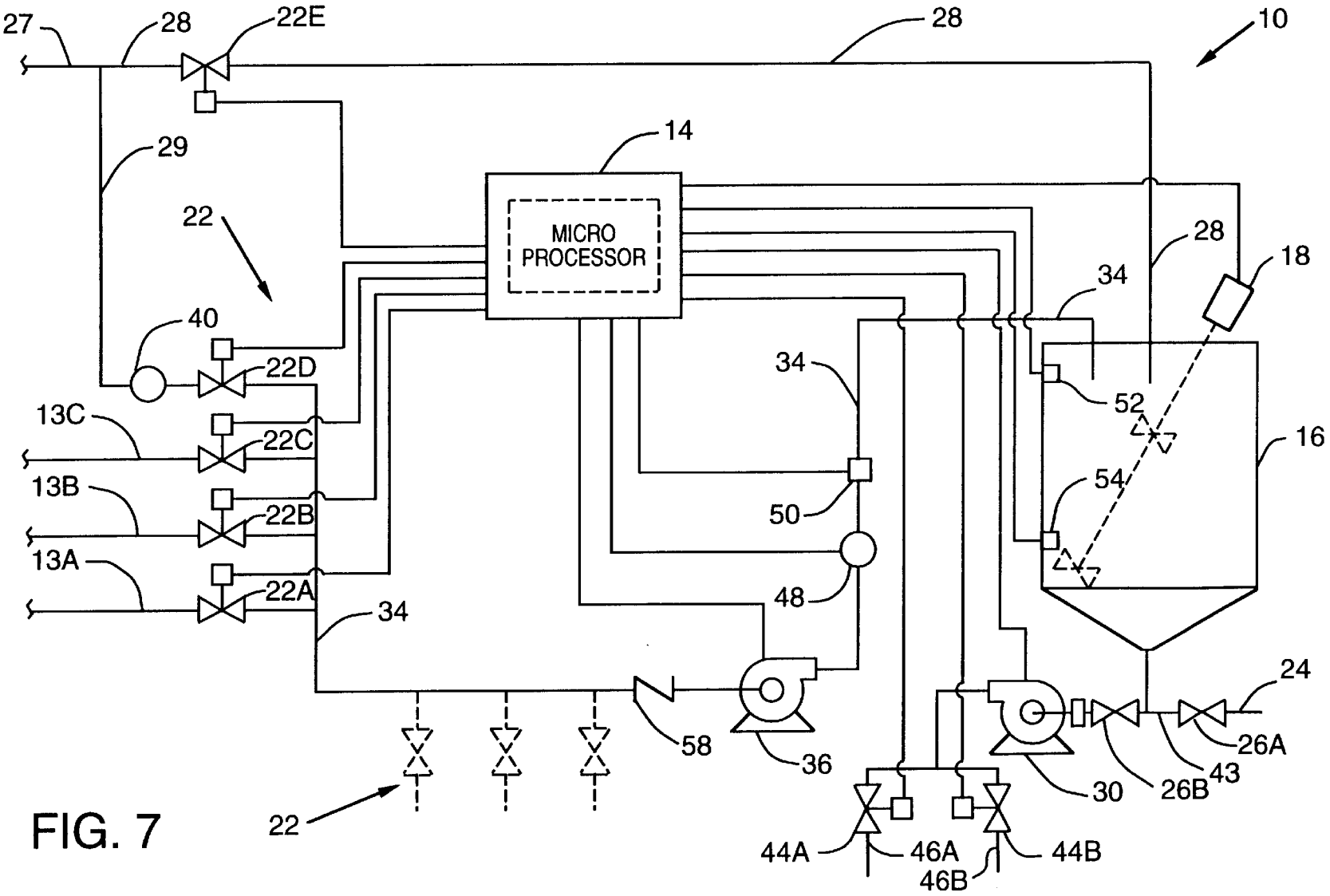
FIG. 7 is a plan view of the chemical blending system according to the present invention.

In order to assist in automating the discharge process, pump line 43 includes a flow switch 56 not shown in FIG. 3 but represented in FIG. 7. Generally, a flow switch operates automatically to protect equipment and pipeline systems against damage from reduction or loss of flow. When detecting flow, flow switch 56 forms a circuit thereby emitting an electrical impulse. In the absence of flow, the circuit is broken. When flow switch 56 does not detect flow, discharge pump 30 is turned off thereby protecting it. Also, flow switch 56 is an indicator of when mixing tank 16 is empty.

Also represented in FIG. 7 are two tank level indicators 52 and 54 inside of mixing tank 16. Level indicators 52 and 54 monitor the liquid level inside of tank 16. Top level indicator 52 determines when tank 16 is full, acting as a check and balance for flow meter 48. If the liquid level were to reach top level indicator 52, chemical blending system 10 would automatically stop feeding ingredients to tank 16 to prevent overflow.

Bottom level indicator 54 works in conjunction with flow switch 56 for determining when tank 16 is empty. Bottom level indicator 54 is a check and balance to flow switch 56. In fact, bottom level indicator 54 is a more precise device for determining when mixing tank 16 is empty. Specifically, when flow switch 56 is not registering flow and when bottom level indicator 54 determines that tank 16 is empty, blending system 10 closes drain valves 44A and 44B and ceases discharging operations.

As described above, exit line 32 also feeds into a gravity drain line 24. As shown in FIG. 1, gravity drain line 24 includes a hand valve 26A. Therefore, in this embodiment, drain line 24 can only be operated manually. Gravity drain line 24 allows the user of chemical blending system 10 the option of draining mixing tank 16 without using discharge pump 30. Line 24 is normally not used during operation of blending system 10. However, in case of power failure or a malfunction, back-up drain line 24 could be used. Also, if more discharge lines were needed on mixing tank 16, another discharge pump could be installed, thereby turning drain line 24 into a discharge line similar to pump line 43.

Represented in FIG. 7, a hand valve 26B can also be placed on pump line 43. Hand valve 26B acts merely as a maintenance device for stopping the flow out pump line 43 in case discharge pump 30 or discharge valves 44A and 44B need servicing or in case other problems arise.

Referring to FIG. 1, blending system 10 includes a support base 20. Mixing tank 16, pumps 30 and 36, inlet valves 22, discharges valves 44A and 44B, agitator 18 and all piping and piping components are supported or mounted on support base 20. Further, a microprocessor 14, which can automatically control all operations of blending system 10, is attached to base 20. Consequently, besides subcomponent tanks 12, the entire blending system 10, can be lifted and transported as a single consolidated unit. Such mobility allows blending system 10 to conveniently be delivered to a customer's facility for on-site blending of products.

FIG. 7 is a plan view of a fully automated chemical blending system 10. A microprocessor 14 receives signals from all electrical equipment and controls the operation of inlet valves 22, feed pump 36, agitator 18, discharge pump 30, and discharge valves 44A and 44B. When formulating a product, microprocessor 14 will open one of the inlet valves 22 and feed an ingredient into feed line 34. Microprocessor 14 will turn feed pump 36 on and pump the ingredient into mixing tank 16. Flow meter 48 will send a signal to microprocessor 14 indicating the amount of the ingredient being fed. When a desired amount of the chemical ingredient has been added, microprocessor 14 will close the inlet valve 22 and begin feeding another ingredient in the same manner. When all of the ingredients or a substantial amount of the ingredients have been added to tank 16, microprocessor 14 activates agitator 18 and begins mixing the solution for a predetermined amount of time. During this time, if the water level in tank 16 were to rise to top level indicator 52, microprocessor 14 would automatically discontinue feeding any chemical ingredients.

Once the product has been formulated and mixed inside of mixing tank 16, microprocessor 14 opens one or both of discharge valves 44A and 44B and activates discharge pump 30. The product is then pumped to a holding tank or directly into a chemical process. Flow switch 56 and bottom level indicator 54 indicate when mixing tank 16 is empty. Microprocessor 14 then turns off discharge pump 30 and closes discharge valves 44A and 44B.

If desired, mixing tank 16 can be rinsed after a product has been discharged. Microprocessor 14 opens inlet valve 22E thereby opening the flow of water into tank 16. As discussed above, rinse line 28 is equipped with a spray nozzle which sprays rinse water on all sides of tank 16. Inlet valve 22E remains open for a predetermined amount of time. The rinse water can then be discharged to a waste stream or to the sewer by opening discharge valve 44A or discharge valve 44B and activating discharge pump 30. Once the rinse water has been emptied, microprocessor 14 turns discharge pump 30 off and closes discharge valve 44A or 44B.

Chemical blending system 10 of FIG. 7 also contains an optional flow switch 50 located after flow meter 48. Flow switch 50 would indicate whether or not there was flow in feed line 34. If no flow were registering, microprocessor 14 would turn feed pump 36 off in order to prevent damage to the pump. However, flow meter 48 can also be used to determine whether there is flow in feed line 34.

Figure 5:
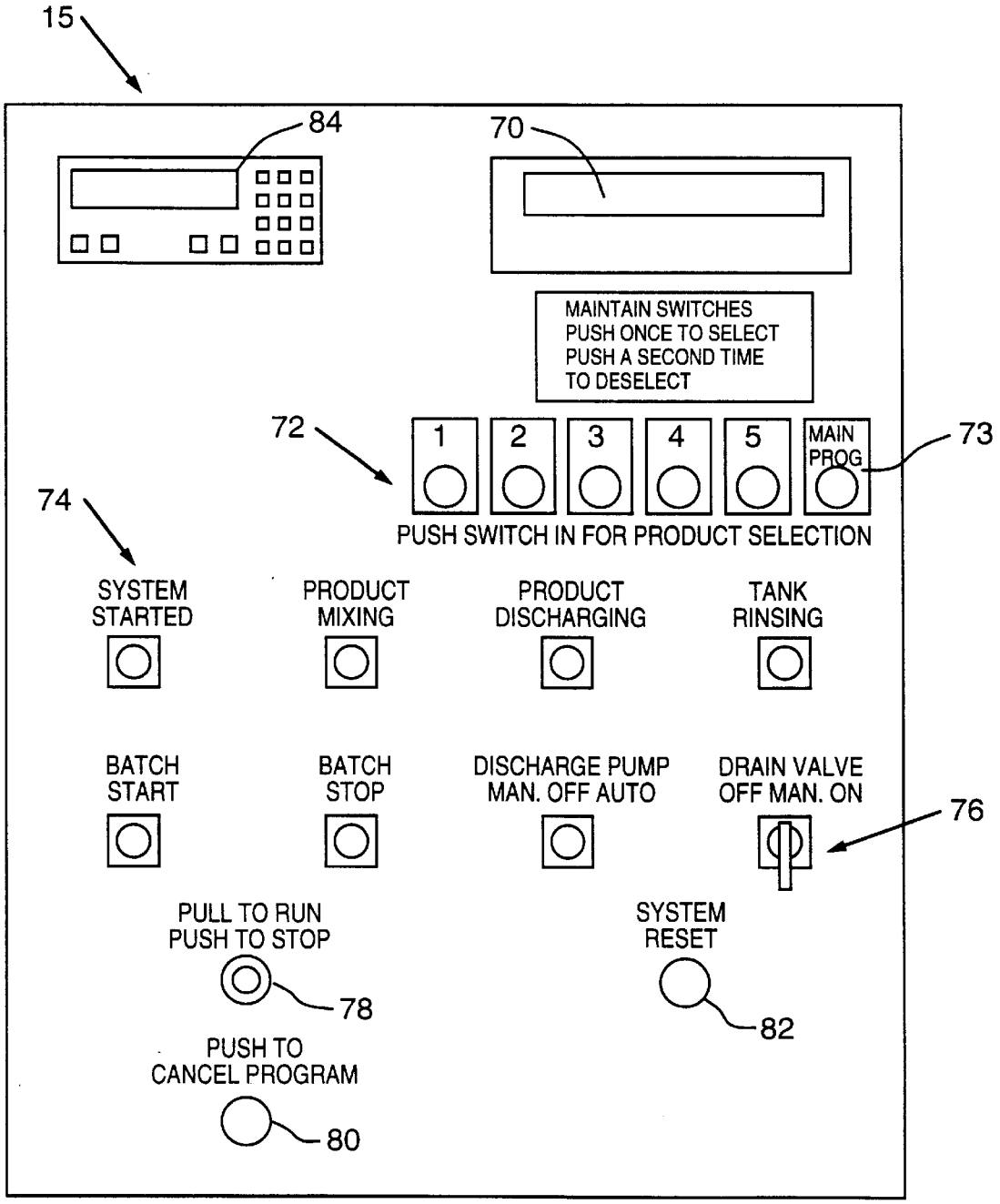
FIG. 5 is a plan view of a control panel used in the chemical blending system of the present invention.

As shown in FIGS. 1 and 2, microprocessor 14 includes a control panel 15 which is illustrated in FIG. 5. Control panel 15 has a plurality of product selection switches, generally 72. Each numbered button corresponds to a particular product. If a customer wanted to produce a product, one of product selection buttons 72 would be activated. When a stop and start button 78 is pulled, chemical blending system 10 would begin making the selected product. While the product is being formulated, a plurality of illuminated panel lights, generally 74, on control panel 15 will indicate at what stage product production is in. Specifically, panel lights 74 include a "system started" light, a "product mixing" light, a "product discharging" light, a "tank rinsing" light, a "batch start" light and a "batch stop" light. Also, on control panel 15 is a display 70. Display 70, in printed form, transmits to the user information about blending system 10. For instance, display 70 can give directions for using system 10 and, more particularly, for using panel 15. Display 70 might tell the user which buttons to push at a particular time. Also, display 70 can indicate the operation being performed and the time it will take for completion.

In the particular embodiment shown, there are five different product selection buttons 72. However, microprocessor 14 is capable of being programmed to formulate many more products than just five. Consequently, the number of product selection buttons 72 appearing on control panel 15 depends upon the number of products a particular customer desires.

Next to product selection button 72 is a "maintenance program" button 73 which is an optional feature to blending system 10. Button 73, when activated, runs a maintenance program on blending system 10. The maintenance program consists of circulating water through the system so the system components do not become corroded from residue left by the chemical products. Specifically, inlet valve 22D is opened allowing water to enter feed line 34, through feed pump 36, into tank 16 and out any discharge lines 46A and 46B. The program runs on a predetermined timed schedule.

Also included on control panel 15 are a pair of manual override switches controlling discharge pump 30 and drain valves 44A and 44B. Switches 76 allow for manual operation of the designated instruments. For instance, switch 76 controlling the discharge pump can be put in the "off" position preventing operation of discharge pump 30. If switched to the "auto" position, microprocessor 14 will be in control of activating discharge pump 30. If switch 76 were put in the "manual" position, discharge pump 30 could be turned on and off with a manual switch. Manual drain valve switch 76 works in the same manner. Switches 76 were installed to anticipate times where manual operation of the equipment would be necessary. Generally, it is desirable not to leave total control of some equipment with microprocessor 14. Thus, more manual override switches may be installed on control panel 15 depending on a customer's needs.

Once a selection has been made on control panel 15, it is possible to stop or cancel the preselected program. First, start and stop button 78 can be pushed in to stop a started process. The process can be continued by pulling button 78. This feature is important when, for instance, a problem exists in the system which needs to be corrected before any desired products are made. On the other hand, a process can be cancelled by pushing a "cancel" button 80. Control panel 15 further contains a system reset button 82. If, for instance, microprocessor 14 sensed a malfunction and shut down a process, once the malfunction was corrected, button 82 would be depressed and the process would start up again from where it was stopped.

The last feature on control panel 15 is a flow meter display 84. Display 84 consists generally of a display screen and a keypad. Not to be used by the customer, display 84 is primarily a maintenance item for programming flow meter 48.

EXAMPLE 1

As mentioned above, chemical blending system 10 of the present invention is particularly applicable for use by chemical suppliers of cleaners and cleaning solvents. For purposes of illustration only in the poultry processing industry, a typical plant may require several cleaning products for use on different machinery and in different applications. Currently, a particular poultry processing plant is capable of using eight different cleaning products made from five chemical subcomponents and water. Specifically, the subcomponents are:

1) sodium hydroxide;
2) sodium hypochlorite or bleach;
3) a mixture of detergents and surfactants;
4) alkaline builder; and
5) a solvent cleaner.

The mixture of detergents and surfactants includes sodium xylene sulfonate which is a surfactant coupling agent, a linear ethoxylated alcohol sold under the trade name ETHAL LA-12, a polyalkene which is an anionic surfactant sold under the trade name TRITON, a linear alkyl sulfonate sold under the trade name DDBSA, and sodium hydroxide. Also, the alkaline builder is a silicate while the solvent cleaner is glycol ether.

From these five chemical subcomponents and with the addition of water, an infinite number of chemical cleaning products can be made. In fact, even though a particular customer may only be using eight or nine products made from the subcomponents, chemical blending system 10 is fully capable of being reprogrammed to modify existing products or to formulate new ones. However, the following products are currently being made from the above-listed subcomponents and water:

| Product No. 1 | |
|---|---|
| Water | 33 Gallons |
| Sodium Hydroxide | 39 Gallons |
| Sodium Hypochlorite | 25 Gallons |
| Alkaline Builder | 3 Gallons |

-continued

| | |
|---|---|
| Product No. 2 | |
| Water | 46 Gallons |
| Mixture of Detergents and Surfactants | 16 Gallons |
| Sodium Hydroxide | 18 Gallons |
| Sodium Hypochlorite | 18 Gallons |
| Alkaline Builder | 2 Gallons |
| Product No. 3 | |
| Water | 41 Gallons |
| Mixture of Detergents and Surfactants | 26 Gallons |
| Sodium Hydroxide | 31 Gallons |
| Alkaline Builder | 2 Gallons |
| Product No. 4 | |
| Sodium Hydroxide | 70 Gallons |
| Sodium Hypochlorite | 20 Gallons |
| Alkaline Builder | 10 Gallons |
| Product No. 5 | |
| Sodium Hydroxide | 75 Gallons |
| Water | 15 Gallons |
| Alkaline Builder | 10 Gallons |
| Product No. 6 | |
| Water | 63 Gallons |
| Sodium Hydroxide | 2 Gallons |
| Mixture of Detergents and Surfactants | 7 Gallons |
| Alkaline Builder | 20 Gallons |
| Solvent Cleaner | 8 Gallons |
| Product No. 7 | |
| Water | 71 Gallons |
| Sodium Hydroxide | 13 Gallons |
| Solvent Cleaner | 4 Gallons |
| Alkaline Builder | 12 Gallons |
| Product No. 8 | |
| Water | 50 Gallons |
| Solvent Cieaner | 4 Gallons |
| Sodium Hydroxide | 36 Gallons |
| Mixture of Detergent and Surfactants | 10 Gallons |

Consequently, only 5 subcomponents need to be delivered to a customer who is using eight different products. Also, the water added to the products is supplied by the customer on site, reducing delivery costs even more.

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to be limitative of the invention so further described in such appended claims.

What is claimed is:

1. An automated chemical delivery and on-site blending system for forming a plurality of preselected chemical products at a determined use site, said system including a plurality of product select switches on a user input control panel corresponding to said respective plurality of chemical products, said system further including a stop and start button on said user input control panel, wherein a user need only activate one of said switches and said start button for automatically forming one of said respective products, said chemical delivery and on-site blending system comprising:

a plurality of containers for respectively holding a corresponding plurality of preselected chemical subcomponents for subsequent controlled blending into said plurality of respective chemical products that are selected by a user, said chemical subcomponents generally being in a chemically concentrated state;

a water intake line for supplying water to said system for controlled dilution of said chemical subcomponents, said water being supplied from a water source at said site;

a plurality of inlet valves each of which corresponds to one of said containers and to said water intake line for controlling the flow of said chemically concentrated subcomponents and said water during formation of said chemical products;

a mixing tank having a top and a bottom;

a chemical feed pump for pumping predetermined measured amounts of said subcomponents and said water into said mixing tank and a means for monitoring the quantity of said subcomponents and said water entering said tank;

a mixing means for mixing said subcomponents and said water for a predetermined interval of time inside of said mixing tank, thereby forming a user selected one of said chemical products;

a chemical exit line connected to said mixing tank, a chemical exit pump and an exit valve for discharging said user selected chemical products from said tank for selective storage and use at said site; and a programmable electronic device including a microprocessor electronically connected to said plurality of product select switches, wherein said electronic device stores information for automatically forming said chemical products when said respective product select switches are user activated.

2. The chemical delivery and on-site blending system as defined in claim 1, wherein said plurality of containers for holding said respective chemical subcomponents: are stackable so that a first container can be stacked upon a second container, have a connecting tube extending from said first container to said second container so that said first container can be replaced when empty and said second container can continuously feed chemical to the blending system, define openings for receiving the tines of a forklift for safe and easy movement of said containers, and are sized for efficient storage on trucks and rail cars.

3. The chemical delivery and on-site blending system as defined in claim 1, wherein said quantity monitoring means includes a flow meter capable of transmitting electronic information to said programmable electronic device for measuring said controlled amounts of said chemical subcomponents and said water.

4. The chemical delivery and on-site blending system as defined in claim 1, wherein said quantity monitoring means includes a load cell which measures amounts of said chemical subcomponents entering said mixing tank by sensing weight differences in said tank.

5. The chemical delivery and on-site blending system as defined in claim 1, wherein said mixing means includes a mixer mounted within said mixing tank.

6. The chemical delivery and on-site blending system as defined in claim 1, further comprising a water rinse line connected to one of said plurality of inlet valves and emptying into said mixing tank, said rinse line including a spray nozzle inside of said tank for rinsing said tank after said chemical products have been formed and discharged.

7. The chemical delivery and on-site blending system as defined in claim 1, wherein said chemical exit line branches off into a plurality of discharge lines, said discharge lines each having a corresponding exit valve.

8. The chemical delivery and on-site blending system as defined in claim 1, further comprising a gravity drain line connected to the bottom of said mixing tank and including a gravity drain valve for providing an alternative means for draining said tank.

9. An automated chemical delivery and on-site blending system for forming at a site a plurality of preselected chemical products from a plurality of chemical subcomponents, wherein more chemical products are formed than there are said chemical subcomponents for reducing the number of chemicals that have to be transported to said site, said chemical delivery and on-site blending system comprising:

a plurality of containers for holding a corresponding plurality of chemical subcomponents, wherein said chemical subcomponents are generally in a chemically concentrated state;

a water intake line for supplying water to said system for controlled dilution of said chemical subcomponents, said water being supplied from a water source at said site;

a plurality of inlet valves corresponding to said containers and to said water intake line for controlling the flow of said chemical subcomponents and said water for controlled blending into said respective chemical products;

a common chemical feedline into which said inlet valves drain;

a mixing tank;

a chemical feed pump for pumping a predetermined measured amount of said chemical subcomponents and said water from said chemical feed line into said mixing tank and an electronic flow meter for monitoring the quantity of said subcomponents and said water entering said tank;

a mixer mounted within said tank for mixing said chemical subcomponents and said water for a predetermined interval of time for forming a user selected one of said chemical products;

a chemical exit line connected to said mixing tank, a chemical exit pump and a plurality of discharge lines;

an exit valve for discharging said plurality of chemical products from said tank for selective storage and use at said site wherein the exit valve is attached to one of said discharge lines; and electrical control means for automatically forming said plurality of chemical products, said electrical control means including a user input control panel having a plurality of product select switches and a stop start button, wherein a user need only activate one of said switches and said start button for forming a corresponding chemical product.

10. The chemical delivery and on-site blending system as defined in claim 9, further comprising a water rinse line connected to one of said plurality of inlet valves and emptying into said mixing tank, said rinse line including a spray nozzle inside of tank for rinsing said tank after said products have been formed and discharged.

* * * * *